US009905409B2

(12) United States Patent
Jarrell et al.

(10) Patent No.: US 9,905,409 B2
(45) Date of Patent: Feb. 27, 2018

(54) DEVICES AND METHODS FOR PERFORMING MASS ANALYSIS

(75) Inventors: Joseph A. Jarrell, Newton Highlands, MA (US); Michael Tomany, Thompson, CT (US)

(73) Assignee: WATERS TECHNOLOGIES CORPORATION, Milford, MA (US)

( * ) Notice: Subject to any disclaimer, the term of this patent is extended or adjusted under 35 U.S.C. 154(b) by 450 days.

(21) Appl. No.: 12/743,285

(22) PCT Filed: Nov. 25, 2008

(86) PCT No.: PCT/US2008/084608

§ 371 (c)(1),
(2), (4) Date: Aug. 4, 2010

(87) PCT Pub. No.: WO2009/070555

PCT Pub. Date: Jun. 4, 2009

(65) Prior Publication Data

US 2010/0320374 A1 Dec. 23, 2010

Related U.S. Application Data

(60) Provisional application No. 60/991,232, filed on Nov. 30, 2007.

(51) Int. Cl.
*H01J 49/06* (2006.01)

(52) U.S. Cl.
CPC ..... *H01J 49/067* (2013.01)

(58) Field of Classification Search
USPC ..... 250/288, 281, 282
See application file for complete search history.

(56) References Cited

U.S. PATENT DOCUMENTS

| | | | | |
|---|---|---|---|---|
| 5,818,041 | A * | 10/1998 | Mordehai et al. | 250/281 |
| 5,825,026 | A | 10/1998 | Baykut | |
| 6,248,999 | B1 | 6/2001 | Mylchreest et al. | |
| 6,700,119 | B1 | 3/2004 | Giles et al. | |
| 7,145,136 | B2 * | 12/2006 | Yang et al. | 250/288 |
| 7,679,053 | B2 * | 3/2010 | Schneider et al. | 250/285 |
| 8,058,611 | B2 * | 11/2011 | Wouters et al. | 250/288 |

(Continued)

FOREIGN PATENT DOCUMENTS

| | | | |
|---|---|---|---|
| JP | 2000-057989 | A | 2/2000 |
| JP | 2000-513873 | A | 10/2000 |

(Continued)

OTHER PUBLICATIONS

Office Action in Japanese Patent Application No. 2010-536110, dated Mar. 19, 2013, 7 pages.

(Continued)

*Primary Examiner* — Kiet T Nguyen
(74) *Attorney, Agent, or Firm* — Schmeiser, Olsen & Watts LLP

(57) ABSTRACT

Embodiments of the present invention feature devices and methods for performing mass analysis. One embodiment of the device comprises an inlet housing for mounting on the first wall between the area of low pressure and the area of high pressure. The inlet housing has passages and restrictions which can be adjusted with respect to a sample plume or changed by substituting alternative inlet housings.

48 Claims, 9 Drawing Sheets

(56) References Cited

U.S. PATENT DOCUMENTS

| | | | |
|---|---|---|---|
| 2003/0052269 | A1 | 3/2003 | Apffel et al. |
| 2003/0094706 | A1 | 5/2003 | Howarth |
| 2004/0094706 | A1 | 5/2004 | Covey et al. |
| 2006/0054805 | A1 | 3/2006 | Flanagan et al. |
| 2006/0131497 | A1 | 6/2006 | Yang et al. |
| 2007/0045531 | A1 | 3/2007 | Mordehai et al. |

FOREIGN PATENT DOCUMENTS

| | | | |
|---|---|---|---|
| JP | 2002-042722 | A | 2/2002 |
| JP | 2002536811 | | 10/2002 |
| JP | 2003-521800 | A | 7/2003 |
| WO | 200048228 | | 8/2008 |

OTHER PUBLICATIONS

Extended European Search Report for Application No. 08853508.3, dated Sep. 15, 2016 (13 pages).
International Search Report and Written Opinion for Application No. PCT/US2008/084608, dated Jan. 30, 2009 (8 pages).
Japanese Search Report for Application No. 2010-536110, dated Mar. 14, 2013 (44 pages).

* cited by examiner

DEVICES AND METHODS FOR PERFORMING MASS ANALYSIS

CROSS REFERENCE TO RELATED APPLICATIONS

This application is the National Stage of International Application No. PCT/US2008/084608, filed Nov. 25, 2008, which claims priority to and benefit of U.S. Provisional Patent Application Ser. No. 60/991,232, filed Nov. 30, 2007. The entire contents of these applications are incorporated herein by reference.

RELATED APPLICATIONS

This application claims priority benefit of a U.S. Provisional Patent Application No. 60/991,232, filed Nov. 30, 2007. The contents of this application is expressly incorporated herein by reference in its entirety.

FIELD OF THE INVENTION

This invention relates to devices and methods of performing mass analysis. And, in particular, devices for mass spectrometers that introduce ions from areas of relatively high pressure to areas of low pressure.

BACKGROUND OF THE INVENTION

As used herein, the terms "mass analyser" or "mass detector" or "mass spectrometer" refer to an apparatus, device or instrument that produces a signal or result based on a mass to charge ratio of analyte ions. Mass analysers may take several common forms, such as, by way of example, without limitation, quadrupole mass filters, ion trap mass analyzers, magnetic sector mass analyzers, time-of-flight mass analyzers, ion-cyclotron resonance (FTMS) analyzers, and Kingdon trap analysers.

Mass spectrometers used for the analysis of biomolecules usually employ atmospheric pressure ionization (API) sources. API sources suitable for the analysis of solutions include electrospray (ESI), atmospheric pressure chemical ionization (APCI) and atmospheric pressure photoionization (APPI), and pneumatically and/or thermally assisted electrospray sources. API is also used with techniques such as matrix assisted laser desorption (MALDI), desorption electrospray ionization (DESI), desorption ionization on silicon (DIOS), and "DART" (direct analysis in real time).

The mass analysis of ions is usually carried out at sub-atmospheric pressures, so that all API techniques require an interface for transmitting ions from the source into a region of relatively high vacuum, usually via one or more evacuated chambers. Ion transmission devices, typically comprising sets of elongated rods or apertured disks to which alternating potentials are applied, are typically provided in chambers where the pressure is sufficiently low for them to be effective. However, most interfaces between API sources and a mass analyzer also comprise a vacuum chamber without an ion transmission device through which the ions have to pass. The following discussion relates particularly to electrospray API sources, but it will be understood that the interfaces described are equally applicable to the other types of API sources listed above, or indeed to any ionization source which generates a plume or spray of ions in a region of relatively high, or atmospheric pressure.

Electrospray ion sources generate an aerosol comprising electrically charged droplets from a solution (often the eluent from a liquid chromatograph) by means of an electrical field applied between a counter electrode and a capillary tube through which the solution flows. The charged droplets may comprise ions characteristic of a sample dissolved in the solution. These charged droplets are at least partially desolvated through contact with gas molecules present in the source, which is usually maintained at atmospheric pressure. Desolvation may be assisted by suitably directing one or more flows of gas in relation to the electrosprayed aerosol, and/or by heating the gas and/or the capillary tube. Replacing the capillary tube with a pneumatic nebulizer (usually a concentric flow nebulizer) may further improve desolvation and additionally may increase the maximum solution flow rate which the source can accept. When a nebulizer is used, the electrospray ionization process may be replaced (or assisted) by a corona discharge (APCI) or a beam of photons (APPI), so that an electrical field between the nebulizer and the capillary may not be necessary.

Whatever processes of ionization and desolvation are used, the ions generated in the atmospheric pressure portion of the source must pass through an interface between the source and the vacuum system of the spectrometer. It is desirable that the interface transmit as many as possible of the ions generated in the aerosol, complete their desolvation without causing losses (for example, by thermal decomposition), and simultaneously separate and remove most of the inert gas and solvent so that the pressure in the mass analyzer is maintained low enough for its proper operation. These requirements are not easily met and many different source and interface designs have been proposed.

The geometrical arrangement of the API source, with respect to the relative orientations of the aerosol and the entrance aperture of the interface, may influence the sensitivity of a mass detector. The structure of the aperture and type of interface have also been found to influence performance.

The interface is subjected to a stream of sample and, due to the small orifices and passageways, can accumulate deposits. It is desirable to have an interface that can be readily removed, cleaned or replaced with an alternative interface.

As used herein, the term "high pressure" refers to relative pressure compared to parts of a mass analyser that operate at low pressures approaching vacuum conditions. The term includes, but is not limited to, "atmospheric pressure". As used herein, "atmospheric pressure" includes the operation of a device in the presence of significant quantities of gas, perhaps with pressures several hundred torr either side of atmospheric pressure itself. The term is generally used in the art to distinguish a type of device and ionization source at or about atmospheric pressures from those that operate under high or medium vacuum, for example, an electron impact or chemical ionization source.

The terms "charged particles" and "ions" are meant to include singly- and multiply-charged ions, solvated and or desolvated ions, adduct ions, and cluster ions, and the like. Ions and/or charged particles are typically formed from a sample in an ionization source operating at atmospheric pressure (as defined above) and potentially carry one or more analytes of interest, other carrier or sample molecules, solvents and gases, charged droplets of solvent and the like.

SUMMARY OF THE INVENTION

Embodiments of the present invention feature devices and methods for performing mass analysis. One embodiment of the present invention is directed to a device for receiving one or more ions travelling in a plume in an area of high pressure and passing the ions into a area of low pressure. The area of high pressure is separated from the area of low pressure by a first wall. The plume has a first axis, and the ions travelling in the low pressure area have a second axis. The device comprises an inlet housing for mounting on the first wall between the area of low pressure and the area of high pressure. The inlet housing has a junction point, first passage and at least one of the inlet housing and the wall has a second passage. The first passage has a first passage axis, an entrance and a terminal end. The entrance is in fluid communication with the area of high pressure and the terminal end is in communication with the junction point. The junction point is in fluid communication with the second passage. The second passage has a second passage axis and an exit. The first passage is for receiving ions from the area of high pressure and the exit is for discharging ions into the area of low pressure. The first passage axis intersects the first axis or a line extending parallel to the first axis at a point and defines a first angle. The first passage axis and said second passage axis intersect at a point and define a second angle. The second passage axis defines the second axis or extending along a line parallel to the second axis. Thus, the inlet housing receives ions at high pressure and passes such ions at low pressure.

One embodiment of the present invention features a device wherein the inlet housing is capable of assuming a first position on the wall and a second position on the wall. In the first position the first passage axis has a first angle of equal to or less than about 75 degrees and in the second position the first passage axis has a first angle of equal to or greater than 105 degrees. Thus, embodiments of the present invention allow the inlet housing to adjust for the plume, or different plumes from alternative sources.

One embodiment of the present invention features a device wherein the inlet housing is mounted to said wall by releasable mounting means. The inlet housing is capable of being removed and reattached to said wall in at least one of a first position and second position. Thus, the inlet housing can be readily serviced, replaced, or adjusted. The releasable mounting means comprises clips, vacuum retention, cams, quick release cams, interlocking flanges, and screws.

One embodiment of the present invention features a device wherein the inlet housing is capable of rotation between said first position and said second position. One embodiment features power means for rotating said inlet housing. Such power means comprise motors, such as stepper motors and the like with suitable gearing to effect movement of the inlet housing. One embodiment further comprises control means in signal communication with the power means. The control means is responsive to operator instructions or operating conditions to set the inlet housing in the first position or the second position. As used herein, the term control means refers to computer processing units (CPUs) and equipment containing CPUs, such as computers, servers, personal computers, and such analytical equipment such as the mass analyser itself.

Preferably, the device has indicia that cooperate with indicia on the wall to allow the inlet housing to be set in a first position or a second position. For example, without limitation, one embodiment features a device having a mark that cooperates with a scale on the wall or vice versa.

One embodiment of the device features a second passage having at least one restriction section defining an area, of at least one of the first passage and second passage, at a higher pressure than the low pressure area. Preferably, the restriction section has a restriction diameter, the first passage has a first passage diameter and the second passage has a second passage diameter.

The restriction diameter has a smaller diameter than at least one of the first passage diameter and the second passage diameter.

One embodiment of the device features a housing shroud. The housing shroud surrounds the inlet housing in a spaced relationship to define a gap. The housing shroud has an opening around the first passage entrance for applying a gas. The housing shroud, preferably, cooperates with the shape and dimensions of the inlet housing. A generally conical shape for both the inlet housing and housing shroud is preferred.

The first passage axis can be set to intersect a line extending with the plume or parallel to the plume. The first passage axis and said second passage axis have an angle of between 10 and 90 degrees. This angle is not readily adjustable, however, the device is simple and inexpensive to make, such that mass spectrometers can readily receive alternative inlet housings with different angles between the first passage axis and second axis passage, different restriction diameters, different first passage diameters, different second passage diameters, and different entrances.

One embodiment of the present invention comprises the device as part of a mass analyser comprising a high pressure area vessel and a low pressure vessel. The high pressure vessel surrounds the inlet housing to contain the plume. Preferably, the wall separating the high and the low pressure vessels have releasable mounting means and alignment indicia.

Preferably, the high pressure area further comprises at least one plume forming means, such as an electrospray or nebuliser, or a plurality of plume forming means. Preferably, the inlet housing has one or more positions for each of the plume forming means.

A further embodiment of the present invention features a method of operating a detector for determining mass to charge ratios of ions. The method comprises the steps of providing at least one high pressure vessel for creating ions and at least one low pressure vessel for creating a signal corresponding to the mass and charge of the ion. The high pressure vessel and low pressure vessel have at least one first wall and an opening allowing fluid and ionic communication between the low pressure vessel and the high pressure vessel. The high pressure vessel has at least one plume forming means. The high pressure vessel is in fluid and ionic communication with the low pressure vessel by the opening. The ions travel along the plume on a first axis and travel in the low pressure vessel on a second axis. The high pressure vessel has an inlet housing mounted on the first wall between the area of low pressure and the area of high pressure. The inlet housing has a junction point, first passage and at least one of the inlet housing and the first wall has a second passage. The first passage has a first passage axis, an entrance and a terminal end. The entrance is in fluid communication with the area of high pressure and the terminal end is in communication with the junction point. The junction point is in fluid communication with the second passage, and the second passage has a second passage axis, and a exit. The first passage is for receiving ions and the exit is for discharging ions into said area of low pressure. The first passage axis intersects the first axis or a line extending parallel to the first axis at a point and defining a first angle. The first passage axis and said second passage axis intersect at a point and define a second angle. The second passage axis defining the second axis or extending along a line parallel to the second axis. The method further comprising the step of receiving ions in the entrance of the first passage at high pressure and passing ions at low pressure into said low pressure vessel for the exit.

The method preferably provides an inlet housing capable of assuming at a first position on said wall and a second position on said wall. And, the method comprises the step of selecting at least one of said first position and second position for said inlet housing. Preferably, in the first position the first passage axis has a first angle of equal to or less than about 75 degrees and in the second position the passage axis has a first angle of equal to or greater than 105 degrees.

The method preferably provides an inlet housing mounted to the first wall by releasable mounting means. And, the method comprises affixing an inlet housing to the wall by the releasable mounting means. The method provides for adjusting the inlet housing to different positions, servicing, maintaining, and replacing the inlet housing. Preferred releasable mounting means comprises clips, vacuum retention, cams, quick release cams, interlocking flanges, and screws. Preferably, the inlet housing and the wall have alignment indicia to facilitate placement of the inlet housing in the desired position.

One method of the present invention provides an inlet housing capable of rotation between the first position and the second position. The method comprises the step of rotating said inlet housing to select a position.

One method of the present invention provides power means for rotating said inlet housing. Preferably, the method further provides control means in signal communication with said power means. The control means is responsive to operator instructions or operating conditions or programming to set the inlet housing in the first position or the second position.

One method of the present invention provides a housing shroud. The housing shroud surrounds the inlet housing in a spaced relationship to define a gap. The housing shroud has a shroud opening around the first passage entrance for applying a gas and the method comprises the step of introducing a gas though the shroud opening.

A preferred device has a shroud housing and inlet housing having cooperating size and shape. A preferred shape is conical and sized to allow the operator to remove and adjust the device within the high pressure vessel.

These and other features and advantages will be apparent to those skilled in the art upon reading the detailed description that follows and viewing the Figures briefly described below.

DETAILED DESCRIPTION OF EMBODIMENTS OF THE INVENTION

Embodiments of the present invention will be described with respect to a inlet for a mass analyser with the understanding that features of the present invention have application to other equipment and analysers as well. The following description to directed to the inventors' preferred embodiments and the best mode of making and using the invention. These embodiments are subject to modification and alteration which changes are understood to be part of the invention.

Figure 1:
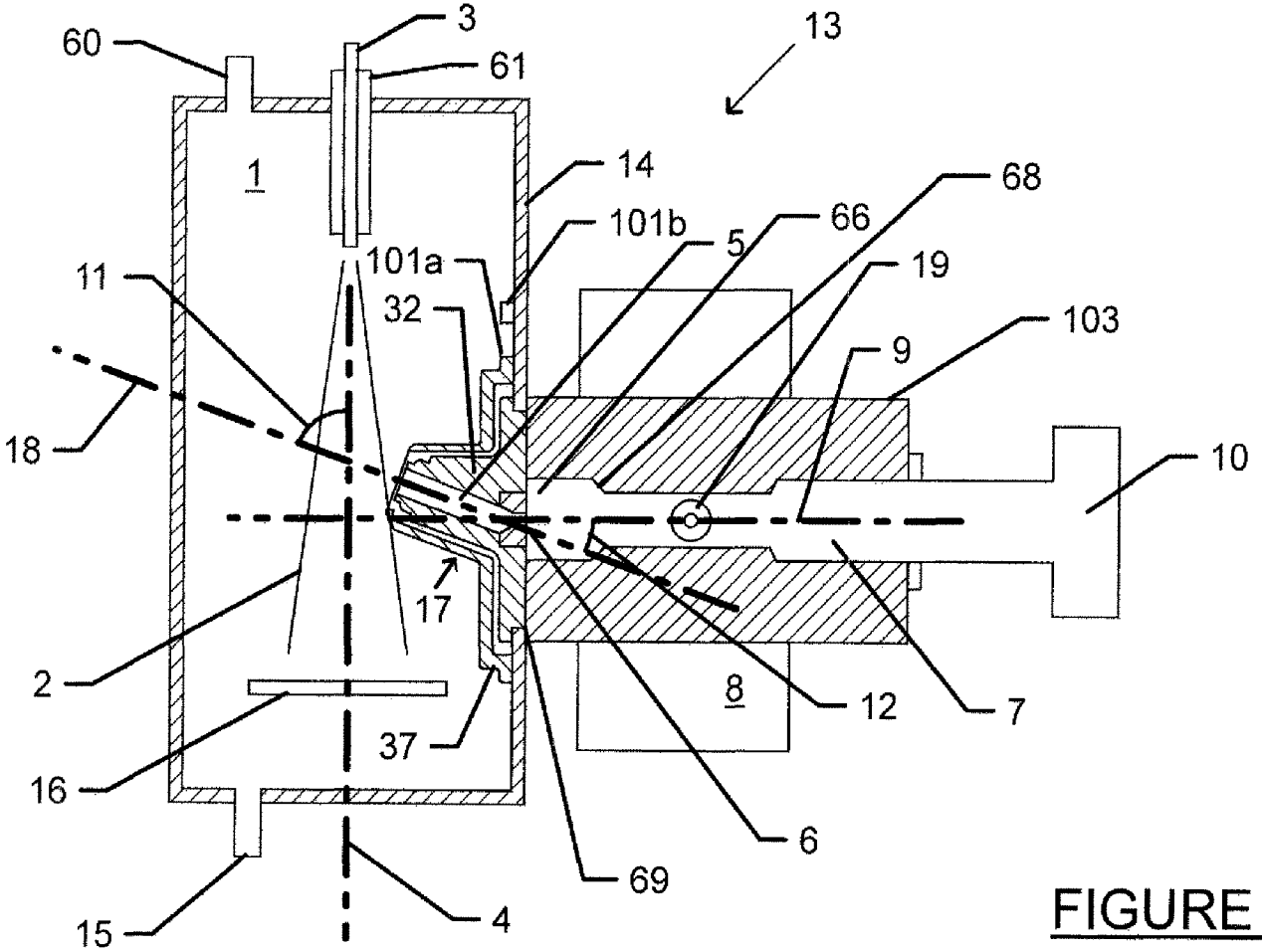
FIG. 1 is a schematic drawing of apparatus for generating charged particles by electrospray ionization incorporating a device according to the invention.
Figure 5:
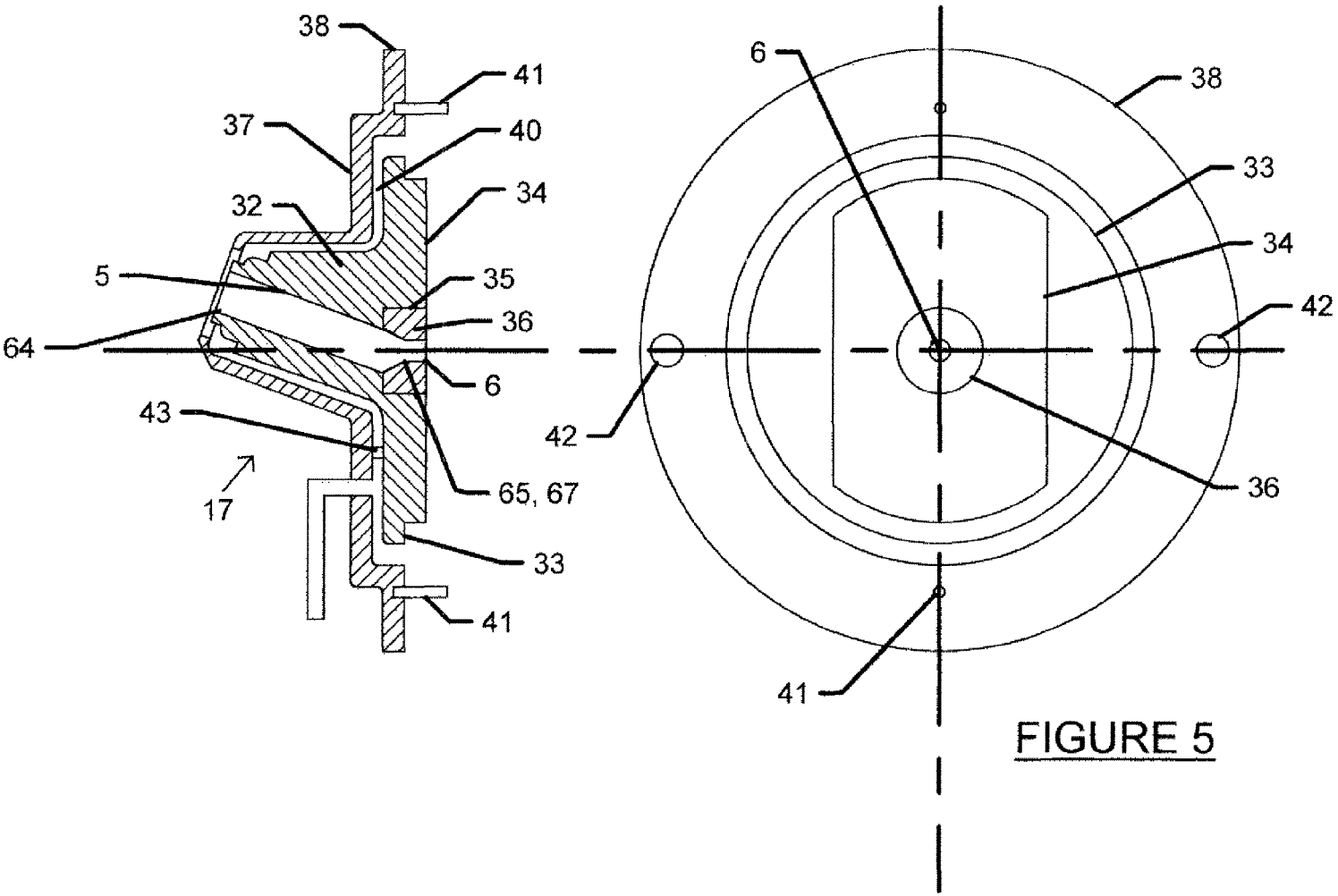
FIG. 5 is a drawing of part of a device according to the invention.

Turning now to FIG. 1 and FIG. 5, such Figures depict an embodiment of a device, generally designated by the numeral 17, according to the invention. It comprises an inlet housing 32 and a shroud housing 37 disposed as shown so that a gap 40 exists between them. As depicted in FIG. 1, both housings are mounted on a wall 14 by wall mounting means comprising items 34, 38, 41 and 42, described in more detail below.

The wall 14 encloses a region 1 of high gas pressure and separates it from a region 7 of lower gas pressure, and is provided with a wall opening 69. The device 17 may be used to receive one or more charged particles travelling along a first axis 4 and pass them through a first passage 5 in the inlet housing 32. The first passage 5 has a first passage axis 18 and comprises an entrance 64 and an exit 65. Device 17 further comprises a second passage 66 that has a second passage axis 9. Second passage 66 further comprises an exit 68 (FIG. 1) and an entrance 67 (FIG. 5) that adjoins the exit 65 of the first passage 5 at a junction point. The first passage axis 18 is inclined to the second passage axis 9. In the FIG. 1 embodiment, the angle 12 between the axes of the first and second passages is 20°. Other angles can be selected from the range of about 10° to 90°. These other angles can be made in alternative substitutable devices 17.

In use, the device 17 may provide fluid communication between the region 1 of high gas pressure and the region 7 of lower gas pressure via the wall opening 69. In order to allow a substantial pressure difference to be maintained between these regions, a restrictor section 6 is incorporated at the entrance 67 of the second passage 66, aligned with the second passage axis 9. It will be appreciated, however, that the restrictor section 6 could equally well be incorporated in the first passage 5, for example close to its exit 65. One embodiment of the present invention features a restrictor section 6 formed in an insert 36 fitted in a counterbore 35 in the exit face 34 of the inlet housing 32. Insert 36 may be a press fit in the counterbore 35, or may be welded in position. Alternatively, it may be a sliding fit to allow different inserts to be used, each having different restrictor sections 6. These may be selected to adjust the gas flow between the regions 1 and 7 to control the pressure in the region of lower pressure 7. Alternative devices 17 are preferably provided with different restrictor sections 6 to allow the device 17 to be selected for conditions and samples.

The restrictor section 6 may form any part or the whole of either or both of the first passage 5 and the second passage 66. However, it is preferred that it is shorter than the passage in which it is comprised and that it is disposed so that at least a portion of the first passage 5 adjacent to its entrance 64 is at substantially the same pressure as that in the region 1 of high gas pressure.

Figure 6:
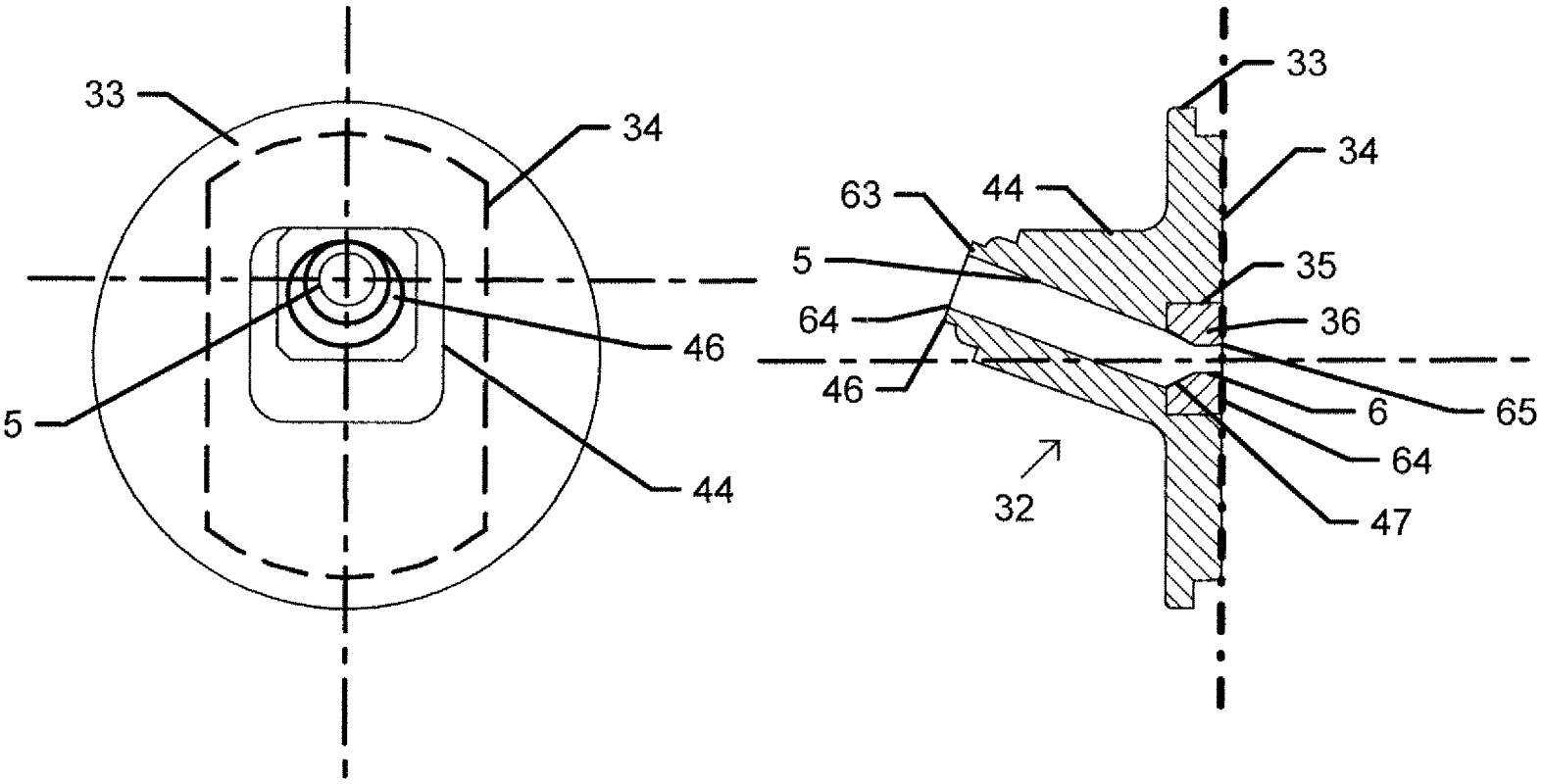
FIG. 6 is a drawing showing more details of a component of the device shown in FIG. 5.

As shown in FIG. 6, an embodiment of the inlet housing 32 has a tapered member 44 having an exit face 34 and an entrance face 46. The tapered member 44 may have a substantially rectangular cross section and may carry a circular boss 63 on which its entrance face 46 is formed. The first passage 5 formed within the tapered member 44 may have a circular cross section and have its entrance 64 in the entrance face 46. To facilitate its mounting on the wall 14, the inlet housing 32 may further comprise a flange portion 33 on which the exit face 34 is formed. The entrance face 46 is smaller in area than the exit face 34. The exit face 34 engages with the wall opening 69 (FIG. 1). The first passage 5 may comprise an internally tapered portion 47 to provide a smooth transition between the diameter of the first passage 5 and the smaller diameter of the restrictor section 6.

Figure 7:
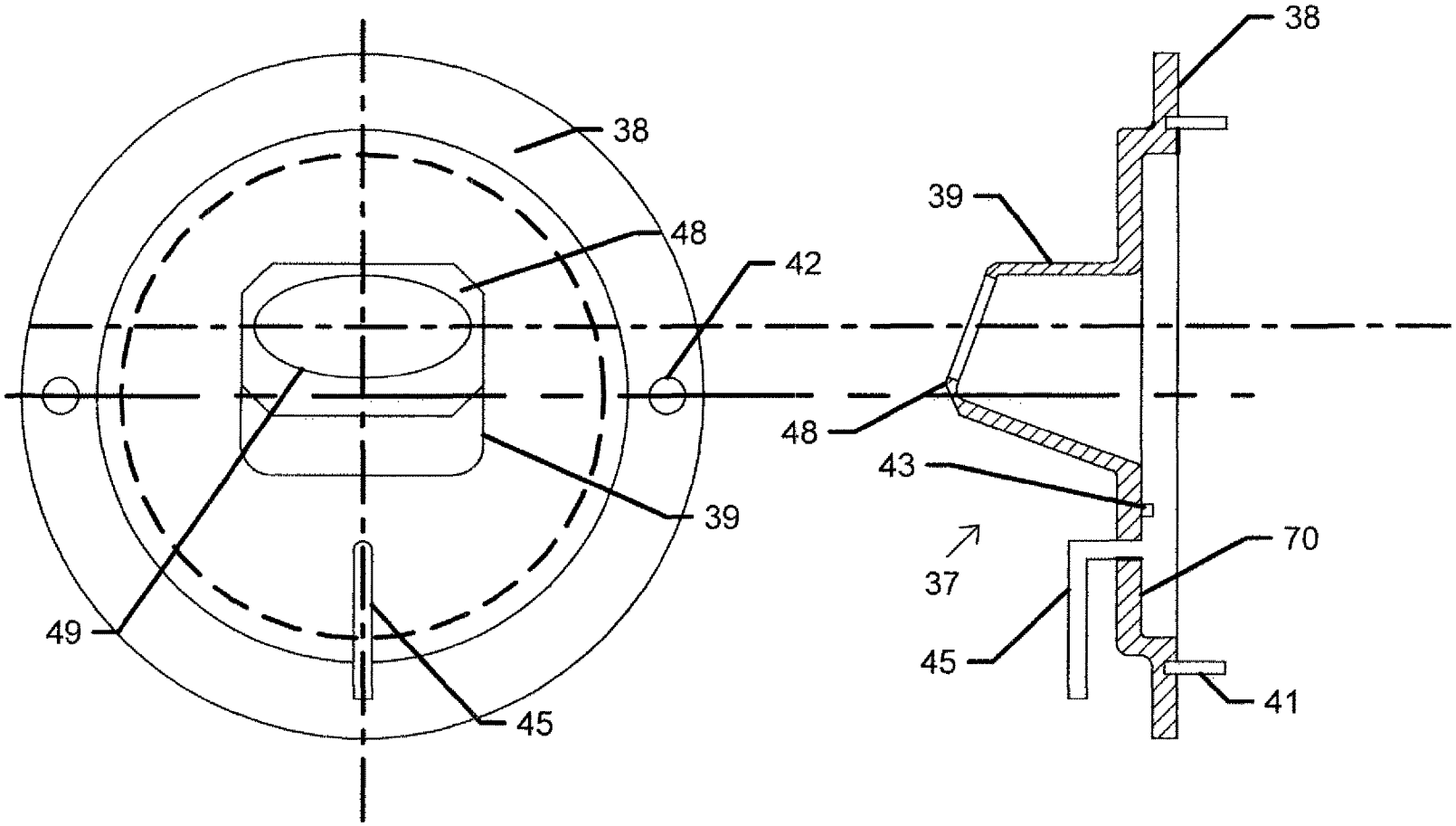
FIG. 7 is a drawing showing more details of another component of the device shown in FIG. 5.

Device 17 has a shroud housing 37 to surround the inlet housing 32 and define a gap 40 between them. As shown in FIG. 7, shroud housing 37 may comprise a tapered body portion 39 and a flange portion 38 adapted for mounting on the wall 14. Flange portion 38 is fitted with two dowels 41 which locate in corresponding holes in wall 14, and is secured to the wall by screws in holes 42. Spacers 43 are provided on the tapered body portion to hold the inlet housing 32 in position on wall 14 when the device 17 is assembled. Together, these components comprise wall mounting means for holding the inlet housing 32 to the wall 14 so that the first passage 5 and second passage 66 cooperate to pass through the wall opening 69 at least some of the charged particles into the region 7 of lower gas pressure. The wall mounting means further ensures that the first passage axis 18 is inclined to the first axis 4 and defines a first angle 11 therebetween. In the illustrated embodiment, the first axis 4 and the first passage axis 18 lie in the same plane, but in other embodiments the two axes may lie in different planes so that the first passage axis 18 is inclined to a line extending parallel to the first axis 4.

Conveniently, the wall mounting means is such that the first angle 11 is less than 75° or greater than 105°. This angle can be adjusted by turning the device 17. As depicted in FIG. 1, device 17 has a mark or pointer 101*a* which cooperates with indicia 101*b* on the wall or associated with the wall 69 to align the device in a desired position.

The tapered body portion 39 is of rectangular cross section such that the gap 40 between it and the inlet housing 32 is of approximately constant width. Tapered body portion 39 has an entrance face 48 which comprises a circular orifice 49 which is disposed adjacent to the entrance face 46 of tapered member 44 when the shroud housing 37 and inlet housing 32 are assembled on the wall 14, as shown in FIG. 5. A gas inlet pipe 45 is provided to allow gas to be introduced into the gap 40 and to flow out of the circular orifice 49 around the entrance 64 of the first passage 5, as discussed in more detail below.

Referring next to FIG. 1, the device 17 may be incorporated in apparatus for generating charged particles, generally indicated by 13. Typically, apparatus 13 may be an atmospheric pressure ionization source, for example an electrospray ionization source, suitable for use in a mass spectrometer. In such apparatus, a fluid comprising a sample to be analyzed (for example, the eluent from a liquid chromatograph) may flow into the region 1 of high gas pressure through an inlet conduit 3. Region 1 is typically maintained at atmospheric pressure, but other pressures are within the scope of the invention, as discussed above. The region 1 of high gas pressure is surrounded by the wall 14, which also separates region 1 from the region 7 of lower gas pressure. A wall opening 69 is provided between the two regions, as explained above. A gas inlet 60 is fitted to the wall 14 and a flow of a heated gas (typically air or nitrogen) is admitted into region 1 and exits through a vent 15. As in prior types of electrospray ionisation sources, an aerosol is generated from a solution of a sample admitted through the inlet conduit 3 and a plume 2 of charged particles is generated. The inlet conduit 3 is maintained at a high potential relative to a counter electrode 16. The plume 2 of charged particles has a first axis 4, as shown in FIG. 1. In the this embodiment, the angle 11 between the first axis 4 and the first passage axis 18 is less than 75°, (shown as 60° in FIG. 1), but other angles can be used. (See the description of the FIG. 2 embodiment, below). Gas, which may optionally be heated and may also be used to assist nebulization, may be introduced into the region 1 through a conduit 61 disposed concentrically with the inlet conduit 3, additionally or alternatively to the gas introduced through the inlet 60. Gas flowing in the region 1 of high gas pressure assists the desolvation of the droplets comprised in the aerosol formed from the inlet conduit 3, but may not always be necessary. Further improvement in the desolvation efficiency, especially at high flow rates, may be obtained by replacing the inlet conduit 3 with a nebulizer similar to those used in APCI ionization sources, as discussed below.

Material (including charged particles, neutral molecules and droplets of solution) may be sampled from the plume 2 into a first passage 5 in the device 17. A second passage 66, in fluid communication with the first passage 5, conveys at least some charged particles from the first passage 5, though the wall opening 69 and into the region 7 of lower gas pressure. Region 7 is maintained at a lower pressure than that in region 1 by a vacuum pump 10. A restrictor section 6 is disposed at the entrance 67 of the second passage 66, as discussed above. The restrictor 6 has a lower conductance than the first passage 5, so that the impedance it presents to a flow of gas between the region 1 and the second passage 66 is largely responsible for the pressure difference between them. This ensures that the pressure in the first passage 5 is substantially that in the region 1.

Figure 2:
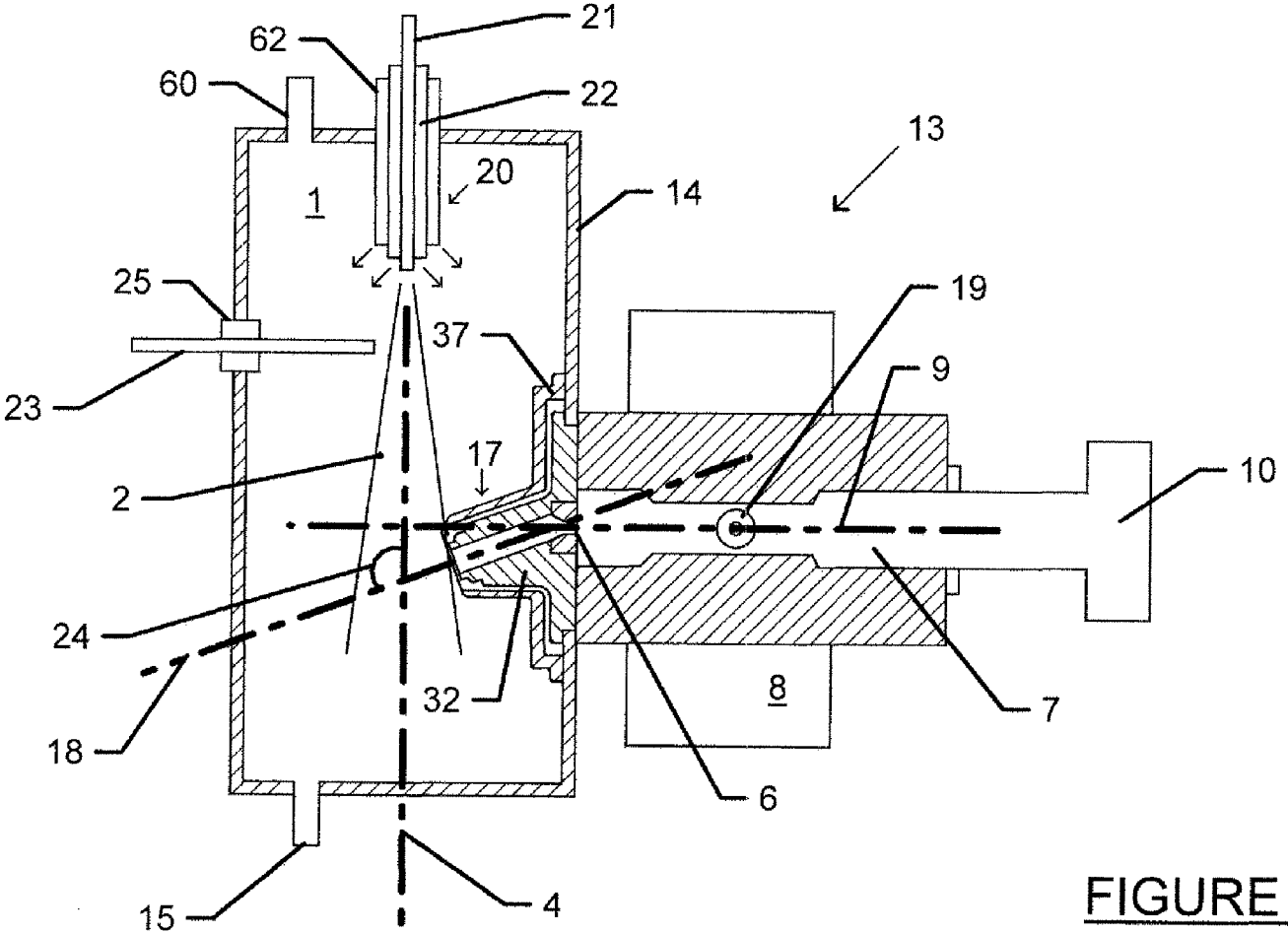
FIG. 2 is a schematic drawing of apparatus for generating charged particles by atmospheric pressure chemical ionization incorporating a device according to the invention.

FIG. 2 shows another embodiment of the invention which is similar to that shown in FIG. 1 but which has an atmospheric pressure chemical ionization source (APCI) in place of the electrospray ionization source shown in FIG. 1. In an APCI source, a nebulizer 20 comprising a sample inlet pipe 21 concentrically disposed in an outer pipe 22 replaces the sample inlet conduit 3 of the FIG. 1 embodiment. A nebulizing gas is introduced into the outer pipe 22 to generate an aerosol from the liquid flowing through the sample inlet pipe 21. Other types of nebulizer, for example a cross-flow pneumatic nebulizer, may also be used. A corona discharge is established in region 1 by means of a potential difference maintained between a discharge electrode 23 (supported in an insulator 25) and the wall 14 and/or the device 17. The corona discharge produces from the aerosol produced by the nebulizer 20 a plume of charged particles 2 directed along the first axis 4. Additional heating means (not shown for clarity) may be used to assist in aerosol desolvation.

As in the embodiment shown in FIG. 1, gas may be introduced into region 1 through a gas inlet 60 and may leave through the vent 15, and may advantageously be heated. Heated desolvation gas may also be caused to flow around nebulizer 20 in a concentric manner through a second gas inlet 62. This arrangement may improve the desolvation of the aerosol, but may not always be necessary.

Also as in the embodiment shown in FIG. 1, some of the charged particles in the plume 2 enter the first passage 5 in the inlet housing 32 and pass into the second passage 66 through the restrictor 6. In the FIG. 2 embodiment, the first passage 5 is disposed so that the angle 24 between the first axis 4 and the first passage axis 18 is greater than 105°, (shown as 120° in FIG. 2). It will be appreciated that this disposition of the first passage 5 relative to the first axis 4 may also be used with the FIG. 1 embodiment, and that the disposition shown in FIG. 1 may be used with the FIG. 2 embodiment. The choice of the angle to be used may be made according to the flow rate of sample through the inlet 3 or the nebulizer 20. A greater angle (for example, angle 24 in FIG. 2), which inclines the first passage axis 18 towards the direction of travel of the charged particles in the plume 2, is most suitable for higher flow rates. A smaller angle, for example angle 11 in FIG. 1, has been found to be more suitable for lower flow rates.

It will be appreciated that the illustration of the electrospray and APCI ion sources in FIGS. 1 and 2, and the descriptions above, are simplified. The detailed design of such sources is well established and further elaboration is unnecessary. Any prior type of APCI or electrospray ion source may be adapted for use in apparatus according to the invention.

Figure 3:
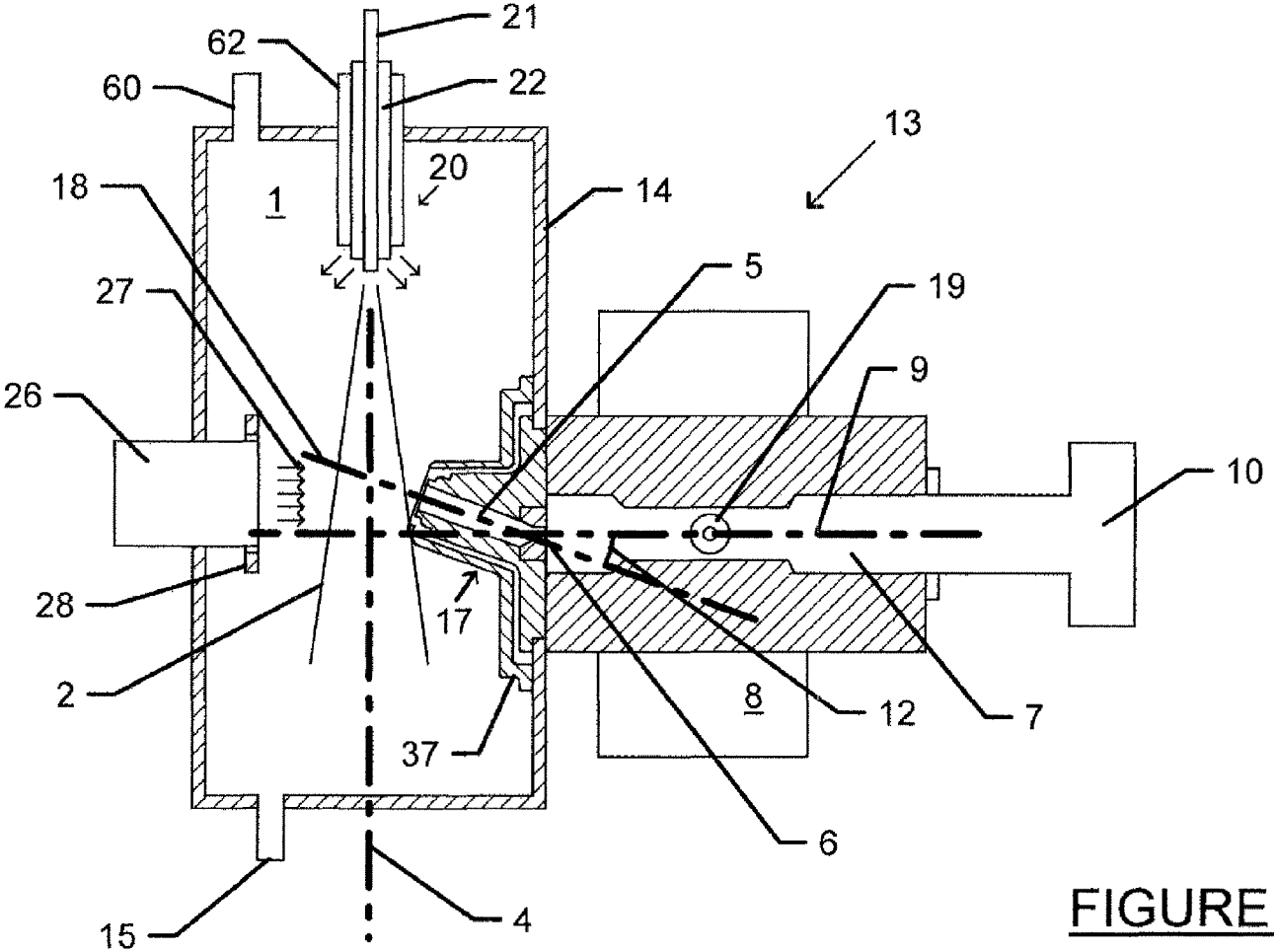
FIG. 3 is a schematic drawing of apparatus for generating charged particles by atmospheric pressure photoionization incorporating a device according to the invention.

FIG. 3 shows another embodiment of the invention that comprises an atmospheric pressure photoionization (APPI) source. As in the case of the FIG. 2 embodiment, a nebulizer 20 generates an aerosol in the region 1 from a liquid containing a sample. Region 1 contains gas, typically air or nitrogen at high pressure (as defined above). Typically, atmospheric pressure may be used. A UV lamp 26 generates a beam of photons (schematically shown at 27) that intersects the aerosol. The various chemical processes associated with the known process of APPI, including the introduction of dopants by means not shown but known in the art, thereby generate a plume of charged particles 2 directed along the first axis 4. Charged particles in the plume may enter the first passage 5 which may be disposed in either of the positions illustrated in FIG. 1 or FIG. 2. The angle between the first axis 4 and the first passage axis 18 is less than 75° or greater than 105°. However, different devices 17 can be substituted with different angles.

An electrical field may also be provided in region 1 to assist the transfer of charged particles into the passage 5, for example by application of a potential difference between a lamp electrode 28 and the shroud housing 37. A restrictor 6 and a second passage 66 are provided and operate as described for the embodiments shown in FIGS. 1 and 2.

As in the embodiment shown in FIG. 1, gas may be introduced into region 1 through the gas inlet 60 and may leave through the vent 15, and may advantageously be heated. Heated desolvation gas may also be caused to flow around nebulizer 20 in a concentric manner through a second gas inlet 62. This arrangement may improve the desolvation of the aerosol, but may not always be necessary.

Figure 4:
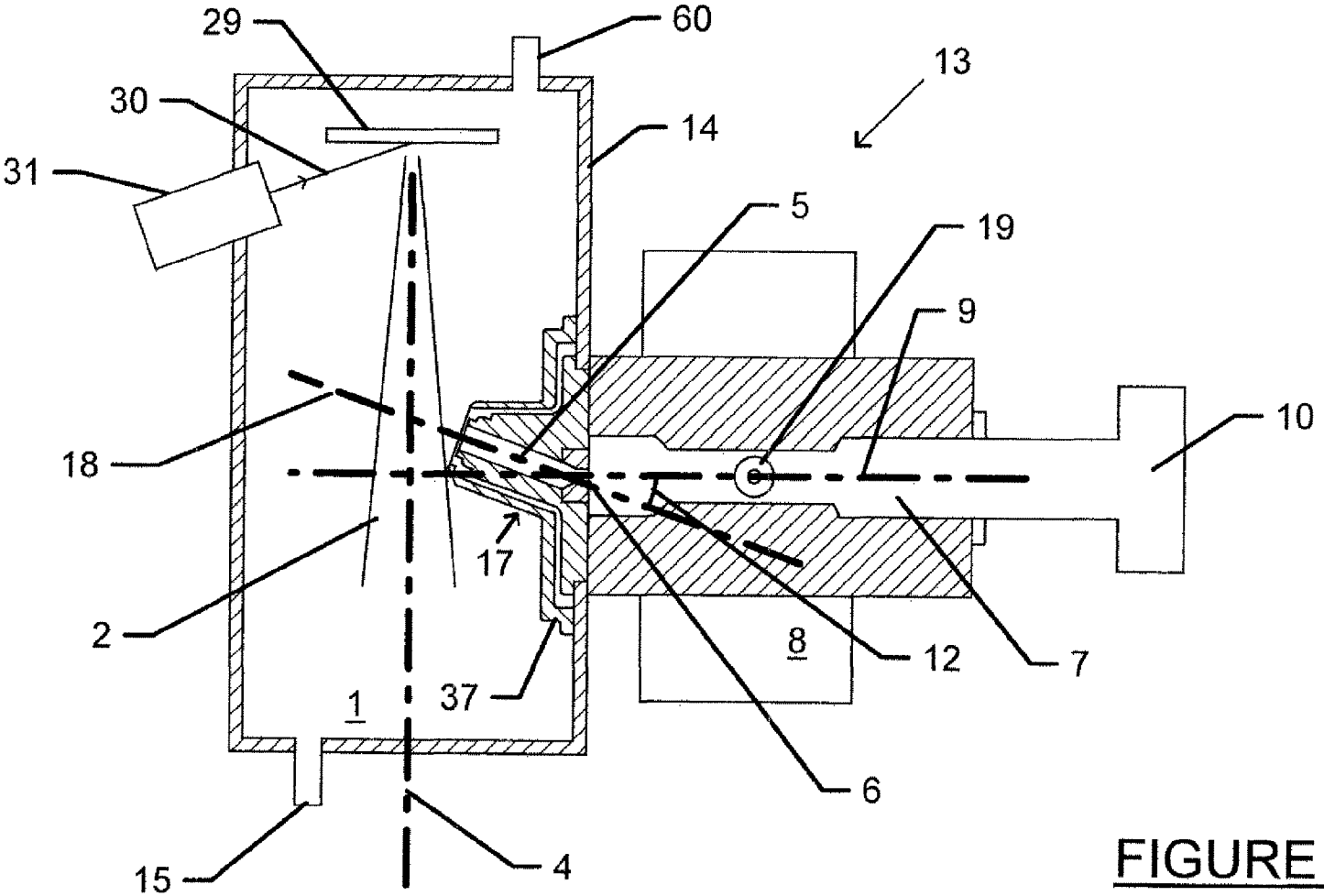
FIG. 4 is a schematic drawing of apparatus for generating charged particles by surface ionization incorporating a device according to the invention.

Another embodiment of the invention is shown ion FIG. 4, wherein a surface 29 is provided in region 1. A sample to be analysed is supported on the surface 29 and a plume of charged particles 2 directed along a first axis 4 is generated from the sample by the impact of a beam of primary particles 30 from a source 31. The FIG. 4 embodiment may comprise a matrix-assisted laser desorption (MALDI) source that operates at a first pressure that is equal to atmospheric pressure (as defined above). Such sources are well known in the art. Briefly, a sample may be either dissolved in a suitable matrix before it is deposited on the surface 29, or in a matrix previously deposited on the surface 29. The source 31 may comprise a laser and the beam of primary particles 30 may comprise photons from the laser. These photons impact the matrix and sample present on the surface 29 and release charged particles therefrom. These charged particles form the plume 2 directed along the first axis 4. As in the embodiments previously described, charged particles from the plume 2 may enter the first passage 5 in the inlet housing 32. This is disposed relative to the first axis 4 as described for the embodiments of FIGS. 1-3. An electrical field (not shown in FIG. 4) may be provided in region 1 to assist the entry of charged particles into the first passage 5. A shroud housing 37, a first restrictor 6, and a second passage 66 are also provided and may be disposed as previously described. A gas inlet 60 is provided in the enclosure 14, through which a gas may be introduced to maintain region 1 at the first pressure. It is sometimes useful to heat this gas and control the direction of its flow.

In certain embodiments of the invention the wall mounting means may be such as to allow the inlet housing 32 to assume either a first position or a second position on the waif 14. such that in the first position the first angle is less than 90° and in the second position the first angle is greater than 90°. In these embodiments, the wall mounting means is such that the housings 32 and 37 are capable of locating only in these two positions. The flange portion 33 of the inlet housing 32 may have an exit face 34 shaped as shown in FIG. 5. This shaped exit face may locate in the wall opening 69 in wall 14, which has a similar shape. This shape allows the inlet housing 32 to be positioned in either of the two positions that are illustrated in FIGS. 1 and 2. Flange 38 of the shroud housing 37 is fitted with two dowels 41 which locate in holes in the wall 14. These dowels are disposed at 180° to one another so that the shroud housing 37 may be located in two different positions, corresponding to the two positions of the inlet housing 32.

FIG. 6 illustrates in more detail an embodiment of the inlet housing 32. It comprises the flange 33 and a tapered member 44 that has a substantially rectangular cross section, as described above. The first passage 5 is perpendicular to the entrance face 46. As shown in FIG. 1, when housing 32 is in position on the wall of the enclosure 14, its exit face 34 is located in a plane that is approximately parallel to the plane in which lies the first axis 4. This disposition allows the angle between the first axis 4 and the first passage axis 18 to be changed by repositioning the housing 32, as explained above. The first passage 5 comprises a circular bore through the tapered member 44, and a circular boss 63 comprising the entrance face 46 is formed on the narrow end of the tapered member 44 as shown. The restrictor section 6 may comprise a small tube of circular cross-section, for example 0.0135" diameter and 0.016" long) formed in the insert 36. The first passage 5 may be 0.062" diameter. These dimensions allow the pressure in the second passageway 66 to be maintained at a pressure of approximately 1 to 3 torr when the pump 10 is a small rotary vacuum pump, (for example 20 $ft^3 \cdot min^{-1}$) when region 1 contains gas at approximately atmospheric pressure.

When mounted as shown in FIGS. 1-4 the second passage axis 9 extends from the restrictor section 6 and along the second passageway itself. Conveniently, the second passage axis 9 is perpendicular to the exit face 34 of the inlet housing 32, as shown in the figures.

An embodiment of the shroud housing 37 is shown in more detail in FIG. 7. It comprises a flange portion 38 and a tapered body portion 39 of rectangular cross section. The body portion 39 has an entrance face 48 that closes the narrowest end of the tapered body portion 39 and comprises a circular orifice 49. Tapered body portion 39 further comprises an exit face 70, as shown. The area of the entrance face 48 is smaller than the area of the exit face 70.

As explained, the flange portion 38 may be secured to the wall 14 by screws in the holes 42 in a first position or a second position, corresponding to the first and second positions of the inlet housing 32, and may hold the inlet housing 32 in position by means of spacers 43. Alternatively, machined structural elements (for example a "quick-lock" coupling) may be used to secure both the housing 37 and the housing 32 to the wall 14, and to space them apart.

A desolvation gas (typically a heated flow of nitrogen or other inert gas) may be introduced into the space 40 through the inlet 45 so that it flows around the tapered member 44 of the housing 32, around the entrance of the first passageway 5 in the circular boss 46 and into region 1 through the orifice 49. Such a gas flow may further assist desolvation of the charged particles as they enter the first passage 5, and help reduce the unwanted admission of contaminants which may be present in the region 1 of high gas pressure.

The inlet housing 32 and shroud housing 37 may be manufactured from metals such as stainless steel, brass, titanium and ceramics.

It will be appreciated that although FIGS. 1-7 are drawn with particular example angles 11, 12 and 24, the device 17 can be constructed with any desired angles that fall within the ranges specified. Further, although the embodiment illustrated in the figures provides two positions for the inlet housing 32 on the wall of enclosure 14, it is also within the scope of the invention to provide more than two positions (corresponding to different angles 11, 12 and 24), or to provide only one position. The invention may also provide several different housings, each having different angles 11, 12 and 24, which can be installed according to the requirements of any particular analysis.

Figure 9:
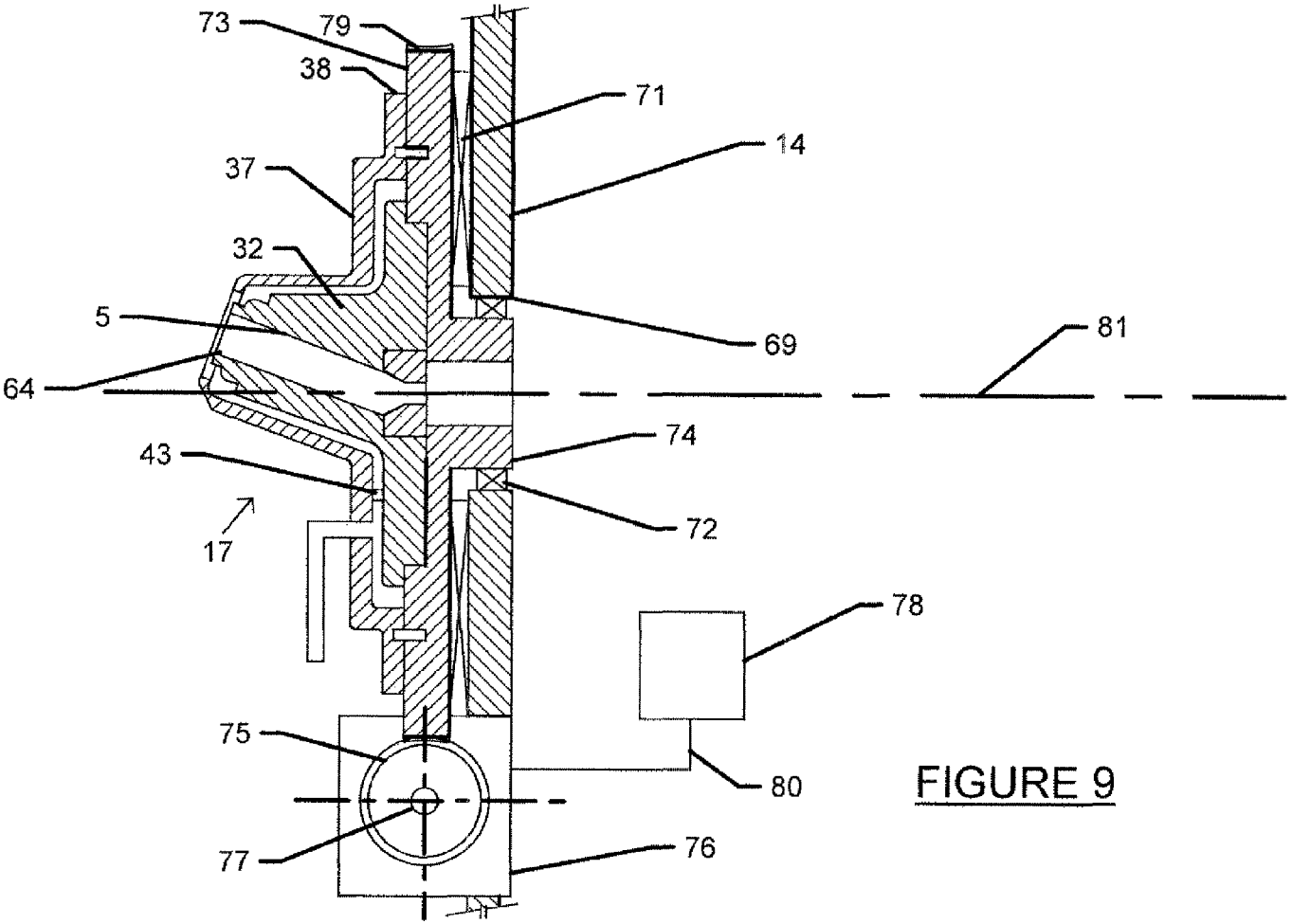
FIG. 9 is a drawing showing another embodiment of a device according to the invention.

FIG. 9 is a drawing of an embodiment in which the wall mounting means permits the inlet housing 32 and the shroud housing 37 to be rotated between at least first and second positions. The housings 32 and 37 are secured to a motion plate 73 that carries a spigot 74. A bearing 72 for the spigot 74 is located in the wall opening 69 in the wall 14, and a thrust bearing 71 is disposed between the motion plate 73 and the wall 14 to allow the motion plate to rotate freely about an axis of rotation 81. An 'O' ring seal (not shown) is provided around the spigot in the wall opening 69. The motion plate 73 is provided with teeth 79 around its circumference that mesh with a worm gear 75 mounted on a shaft 77. Power means for rotating the motion plate 73 (and with it the housings 32 and 37) between the first and second positions comprise a motor 76, which drives the shaft 77. Control means 78 are in signal communication with the power means comprising the motor 76 via an electrical connection 80, and may be responsive to operator's instructions to set the housings in the desired positions. The first and second positions may correspond to those illustrated in FIGS. 1 and 2, but other positions are within the scope of the invention. The control means 78 may be implemented in software adapted to run on a computer used to control a mass spectrometer incorporating the apparatus shown in FIG. 9. The control means 78 may be also be responsive to the operating conditions or the results being obtained for a given analysis, to set the housings in a position most appropriate for an analysis being carried out.

Figure 8:
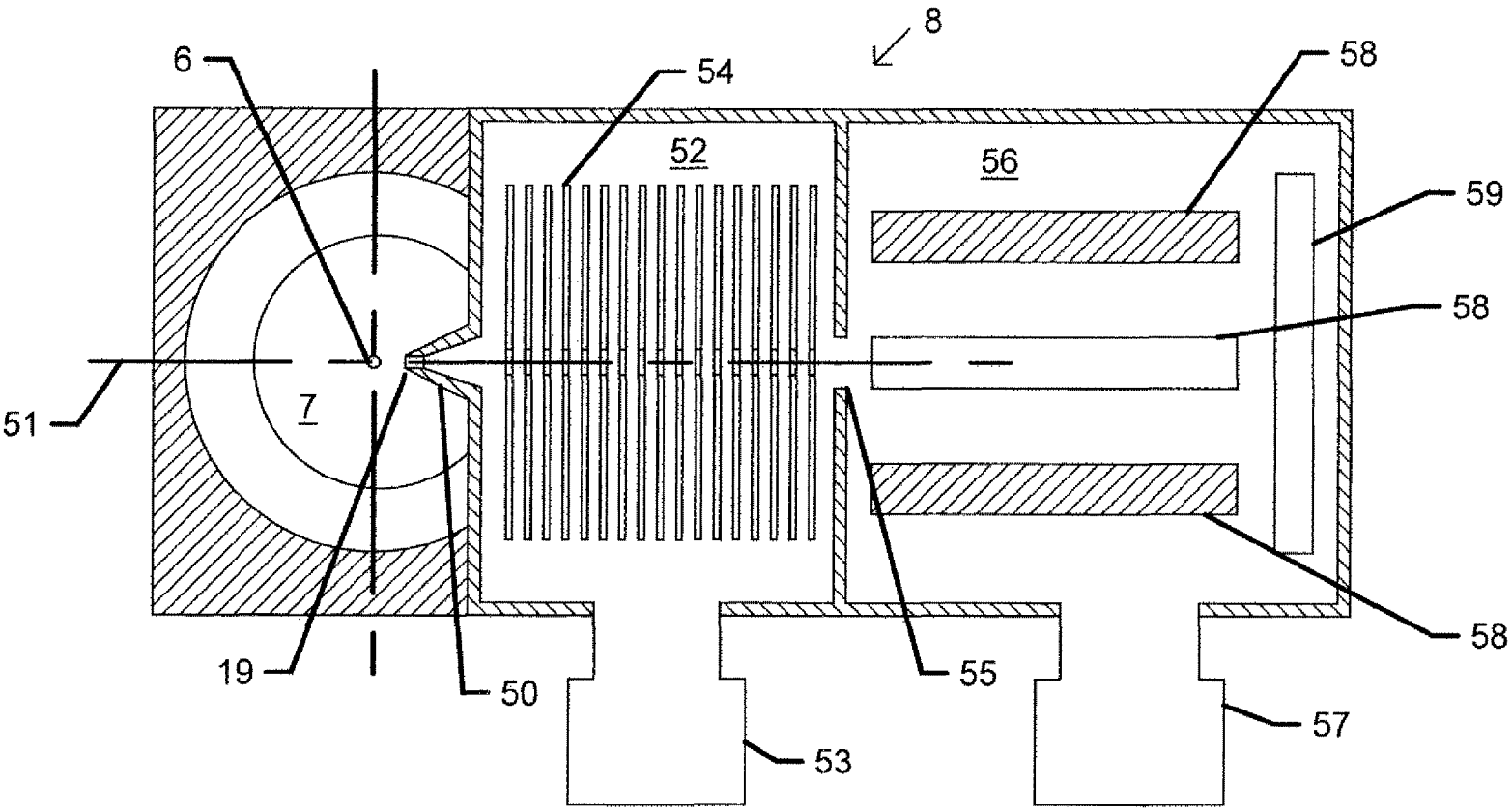
FIG. 8 is a simplified schematic drawing of a mass spectrometer incorporating ionization sources having a device according to the invention.

FIG. 8 is a drawing of an example mass spectrometer according to the invention. Charged particles, which have entered the region 7 of lower gas pressure along the second passage axis 9, travel towards the pump 10 as shown in FIG. 1. A second restrictor 19 connects the region 7 with a region 52 of still lower pressure (FIG. 8) that is maintained at a pressure below that of region 7 by a turbomolecular pump 53. Charged particles entering the second restrictor 19 pass along a second axis 51 that is inclined to the second passage axis 9. Conveniently, the second axis 51 is perpendicularly disposed to the second passage axis 9.

A mass analyser and interface 8 (FIGS. 1-4 and 8) is disposed to receive charged particles travelling along the second axis 51. Mass analyser and interface 8 may produce mass spectral information relating to the charged particles or species derived form them.

The second restrictor 19 (FIGS. 1-4 and 8) may comprise a hollow conical member 50 aligned with the second axis 51. The region 52 of still lower pressure may be maintained at a pressure of less than about $10^{-2}$ torr. Mass analyser and interface 8 may comprise an ion guide 54 comprising a stack of annular electrodes to which appropriate AC voltages are applied may be provided in region 52 to assist the transmission of charged particles through an orifice 55 into an analyser vacuum chamber 56. Chamber 56 may be maintained at a pressure of less than about $10^{-5}$ torr by a turbomolecular vacuum pump 57. Mass analyser and interface 8 may further comprise a conventional quadrupole mass filter comprising four electrodes (of which three are shown at 58 in FIG. 8) that receives at least some of the charged particles are transmitted by the ion guide 54 through the orifice 55. A charged particle detector 59 receives charged particles exiting from the mass filter.

The mass analyser and interface 8 described above and shown in FIG. 8 is by way of example only. It is within the scope of the invention to use different configurations of mass filters, ion guides, and vacuum chambers. For example, the single quadrupole mass filter shown in FIG. 8 may be replaced by a conventional triple quadrupole mass filter comprising two quadrupole mass filters and one or more gas collision cells, a time-of-flight mass analyser, a magnetic sector mass analyser, an ion trap mass analyser, a Fourier Transform mass analyser, or any combination of such mass analysers and/or collision cells. Ion trap mass analysers that may be employed include, but are not limited to, 3-D quadrupole ion traps ("Quistors"), cylindrical ion traps, and "Kingdon" orbital trapping devices (also known as "Orbitraps"). The combination of mass analysers and collision cells may be determined by the type of analyses to be carried out.

Similarly, the ion guide 54 in region 52 may be replaced by any other type of ion transmission device, for example quadrupole, hexapole or octupole rod sets, or more than one stack of annular electrodes. Alternatively, the ion guide may be replaced by focussing electrodes supplied only with direct potentials, or omitted altogether. It is also within the scope of the invention to provide more than one intermediate vacuum chamber between the second passage 66 and the analyser vacuum chamber 56, or even omit region 52 so that the second passage 66 communicates directly with the analyser vacuum chamber 56.

In FIG. 8 the apparatus downstream of the second restrictor 19 is shown in a highly simplified form, omitting many features that may be necessary for the proper operation of a high performance mass analyser. Such analysers are well known in the art, however, so that a more detailed description is not required.

Although in FIG. 8 the second axis 51 is shown perpendicularly disposed to the second passage axis 9, this is not an essential feature. It is within the scope of the invention to provide any angle between these two axes, including a linear disposition such that the second axis 51 is an extension of the second passage axis 9.

Thus, preferred embodiments of the present invention have been described in detail with the understanding that the features of the present description are capable of being modified and altered without departing from the teaching.

Therefore, the present invention should not be limited to the precise details but should encompass the subject matter of the claims and their equivalents.

For example, housings 32 and 37 may be mounted directly on element 101 which contains passageway 7 if element 103 is sufficiently large. Wall 14 could then mount on an outer portion of element 101.

What is claimed:

1. A device for receiving one or more ions travelling in a plume in an area of high pressure and passing said ions into an area of low pressure, said area of high pressure separated from said area of low pressure by a first wall, said plume having a first axis, and said ions travelling in said low pressure area having a second axis; said device comprising:

an inlet housing for mounting on said first wall between said area of low pressure and said area of high pressure, said inlet housing having a junction point, a first passage and at least one of said inlet housing and said wall having a second passage, said first passage having a first passage axis, an entrance end and a terminal end, said entrance end in fluid communication with said area of high pressure and said terminal end in communication with said junction point, said junction point in fluid communication with said second passage, said second passage having a second passage axis, and an exit, said first passage for receiving ions and said exit for discharging ions into said area of low pressure; said first passage axis intersecting said first axis or a line extending parallel to said first axis at a point and defining a first angle, said first passage axis and said second passage axis intersecting at a point and defining a second angle, and said second passage axis defining said second axis or extending along a line parallel to said second axis, said inlet housing for receiving ions at high pressure and passing ions at low pressure, wherein said inlet housing is capable of assuming a first position on said wall and a second position on said wall, in said first position said first passage axis has a first angle of equal to or less than about 75 degrees and in said second position said first passage axis has a first angle of equal to or greater than 105 degrees.

2. The device of claim 1 wherein said second passage has at least one restriction section defining an area of at least one of said first passage and said second passage at a higher pressure than said low pressure area.

3. The device of claim 2 wherein said restriction section has a restriction diameter, said first passage has a first passage diameter and said second passage has a second passage diameter, said restriction diameter having a smaller diameter than at least one of said first passage diameter and said second passage diameter.

4. The device of claim 1 wherein said inlet housing is mounted to said first wall by releasable mounting means.

5. The device of claim 4 wherein said releasable mounting means comprises clips, vacuum retention, cams, quick release cams, interlocking flanges, or screws.

6. The device of claim 1 wherein said inlet housing is capable of being removed and reattached to said first wall in at first one of said first position and said second position.

7. The device of claim 1 wherein said inlet housing is capable of rotation between said first position and said second position.

8. The device of claim 7 further comprising power means for rotating said inlet housing.

9. The device of claim 8 further comprising control means in signal communication with said power means said control means responsive to operator instructions or operating conditions to set said inlet housing in said first position or said second position.

10. The device of claim 1 further comprising a housing shroud, said shroud surrounding said inlet housing in a spaced relationship to define a gap and having an opening around said first passage entrance for applying a gas.

11. The device of claim 10 wherein said housing shroud has a conical shape.

12. The device of claim 1 wherein said first passage axis intersects a line extending parallel to said plume.

13. The device of claim 1 wherein said first passage axis and said second passage axis have an angle of between 10 and 90 degrees.

14. The device of claim 1 wherein said high pressure area comprises a high pressure vessel, said high pressure vessel for surrounding said inlet housing.

15. The device of claim 1 wherein said low pressure area comprises a low pressure vessel and wherein said inlet housing and said low pressure vessel have releasable mounting means.

16. The device of claim 15 wherein said inlet housing and said low pressure vessel have alignment indicia.

17. The device of claim 1 further comprising at least one plume forming means held in said high pressure area.

18. The device of claim 17 wherein said at least one plume forming means is an electrospray or nebulizer.

19. A detector for determining mass to charge ratios of ions comprising at least one high pressure vessel for creating ions and at least one low pressure vessel for creating a signal corresponding to the mass and charge of the ion, said high pressure vessel and low pressure vessel having at least one first wall and an opening allowing fluid and ionic communication between said low pressure vessel and said high pressure vessel, said high pressure vessel having at least one plume forming means and a first axis and said low pressure vessel having a second axis, said high pressure vessel having an inlet housing for mounting on said first wall between an area of low pressure and an area of high pressure, said inlet housing having a junction point, a first passage and at least one of said inlet housing and said wall having a second passage, said first passage having a first passage axis, an entrance end and a terminal end, said entrance end in fluid communication with said area of high pressure and said terminal end in communication with said junction point, said junction point in fluid communication with said second passage, said second passage having a second passage axis, and an exit, said first passage for receiving ions and said exit for discharging ions into said area of low pressure; said first passage axis intersecting said first axis or a line extending parallel to said first axis at a point and defining a first angle, said first passage axis and said second passage axis intersecting at a point and defining a second angle, and said second passage axis defining said second axis or extending along a line parallel to said second axis, said inlet housing for receiving ions at high pressure and passing ions at low pressure into said low pressure vessel, wherein said inlet housing is capable of assuming a first position on said wall and a second position on said wall, in said first position said first passage axis has a first angle of equal to or less than about 75 degrees and in said second position said first passage axis has a first angle of equal to or greater than 105 degrees.

20. The detector of claim 19 wherein said second passage has at least one restriction section defining an area of at least one of said first passage and said second passage at a higher pressure than said low pressure area.

21. The detector of claim 20 wherein said restriction section has a restriction diameter, said first passage has a first passage diameter and said second passage has a second passage diameter, said restriction diameter having a smaller diameter than at least one of said first passage diameter and said second passage diameter.

22. The detector of claim 19 wherein said inlet housing is mounted to said wall by releasable mounting means.

23. The detector of claim 22 wherein said inlet housing is capable of being removed and reattached to said wall in at least one of a first position and a second position.

24. The detector of claim 22 wherein said releasable mounting means comprises clips, vacuum retention, cams, quick release cams, interlocking flanges, or screws.

25. The detector of claim 19 wherein said inlet housing is capable of rotation between said first position and said second position.

26. The detector of claim 25 further comprising power means for rotating said inlet housing.

27. The detector of claim 26 further comprising control means in signal communication with said power means said control means responsive to operator instructions or operating conditions to set said inlet housing in said first position or said second position.

28. The detector of claim 19 further comprising a housing shroud, said shroud surrounding said inlet housing in a spaced relationship to define a gap and having an opening around said first passage entrance for applying a gas.

29. The detector of claim 28 wherein said housing shroud has a conical shape.

30. The detector of claim 19 wherein said first passage axis intersects a line extending parallel to said plume.

31. A method of operating a detector for determining mass to charge ratios of ions comprising the steps of providing at least one high pressure vessel for creating ions and at least one low pressure vessel for creating a signal corresponding to the mass and charge of the ion, said high pressure vessel and low pressure vessel having at least one first wall and an opening allowing fluid and ionic communication between said low pressure vessel and said high pressure vessel, said high pressure vessel having at least one plume forming means and a first axis and said low pressure vessel having a second axis, said high pressure vessel having an inlet housing for mounting on said first wall between an area of low pressure and an area of high pressure, said inlet housing having a junction point, a first passage and at least one of said inlet housing and said wall having a second passage, said first passage having a first passage axis, an entrance end and a terminal end, said entrance end in fluid communication with said area of high pressure and said terminal end in communication with said junction point, said junction point in fluid communication with said second passage, said second passage having a second passage axis, and an exit, said first passage for receiving ions and said exit for discharging ions into said area of low pressure; said first passage axis intersecting said first axis or a line extending parallel to said first axis at a point and defining a first angle, said first passage axis and said second passage axis intersecting at a point and defining a second angle, and said second passage axis defining said second axis or extending along a line parallel to said second axis, said inlet housing for receiving ions at high pressure and passing ions at low pressure into said low pressure vessel, wherein said inlet housing is capable of assuming a first position on said wall and a second position on said wall, in said first position said first passage axis has a first angle of equal to or less than about 75 degrees and in said second position said first passage axis has a first angle of equal to or greater than 105 degrees and said method comprises the step of selecting at least one of said first position and said second position for said inlet housing.

32. The method of claim 31 wherein said inlet housing is mounted to said wall by releasable mounting means and said method comprises affixing an inlet housing to said wall by said releasable mounting means.

33. The method of claim 32 wherein said releasable mounting means comprises clips, vacuum retention, cams, quick release cams, interlocking flanges, or screws.

34. The method of claim 31 wherein said inlet housing is capable of being removed and reattached to said wall in at least one of a first position and a second position and said method comprises the step of servicing said inlet housing prior to affixing in said first or second position.

35. The method of claim 31 wherein said inlet housing is capable of rotation between said first position and said second position and said method comprises the step of rotating said inlet housing to select said first or second position.

36. The method of claim 31 further comprising power means for rotating said inlet housing.

37. The method of claim 36 further comprising control means in signal communication with said power means said control means responsive to operator instructions or operating conditions to set said inlet housing in said first position or said second position.

38. The method of claim 31 further comprising a housing shroud, said shroud surrounding said inlet housing in a spaced relationship to define a gap and having an opening around said first passage entrance for applying a gas.

39. The method of claim 31 wherein said inlet housing is aligned with indicia.

40. A device for receiving one or more ions travelling in a plume in an area of high pressure and passing said ions into an area of low pressure, said area of high pressure separated from said area of low pressure by a first wall, said plume having a first axis, and said ions travelling in said low pressure area having a second axis; said device comprising:

an inlet housing for mounting on said first wall between said area of low pressure and said area of high pressure, said inlet housing having a junction point, a first passage and at least one of said inlet housing and said wall having a second passage, said first passage having a first passage axis, an entrance end and a terminal end, said entrance end in fluid communication with said area of high pressure and said terminal end in communication with said junction point, said junction point in fluid communication with said second passage, said second passage having a second passage axis, and an exit, said first passage for receiving ions and said exit for discharging ions into said area of low pressure; said first passage axis intersecting said first axis or a line extending parallel to said first axis at a point and defining a first angle, said first passage axis and said second passage axis intersecting at a point and defining a second angle, and said second passage axis defining said second axis or extending along a line parallel to said second axis, said inlet housing for receiving ions at high pressure and passing ions at low pressure, wherein said inlet housing is capable of rotation between a first position and a second position to change a value of said first angle between said first passage axis and said first axis or said line extending parallel to said first axis.

41. The device of claim 40 further comprising power means for rotating said inlet housing.

42. The device of claim 41 further comprising control means in signal communication with said power means said control means responsive to operator instructions or operating conditions to set said inlet housing in said first position or said second position.

43. A detector for determining mass to charge ratios of ions comprising at least one high pressure vessel for creating ions and at least one low pressure vessel for creating a signal corresponding to the mass and charge of the ion, said high pressure vessel and low pressure vessel having at least one first wall and an opening allowing fluid and ionic communication between said low pressure vessel and said high pressure vessel, said high pressure vessel having at least one plume forming means and a first axis and said low pressure vessel having a second axis, said high pressure vessel having an inlet housing for mounting on said first wall between an area of low pressure and an area of high pressure, said inlet housing having a junction point, a first passage and at least one of said inlet housing and said wall having a second passage, said first passage having a first passage axis, an entrance end and a terminal end, said entrance end in fluid communication with said area of high pressure and said terminal end in communication with said junction point, said junction point in fluid communication with said second passage, said second passage having a second passage axis, and an exit, said first passage for receiving ions and said exit for discharging ions into said area of low pressure; said first passage axis intersecting said first axis or a line extending parallel to said first axis at a point and defining a first angle, said first passage axis and said second passage axis intersecting at a point and defining a second angle, and said second passage axis defining said second axis or extending along a line parallel to said second axis, said inlet housing for receiving ions at high pressure and passing ions at low pressure into said low pressure vessel, wherein said inlet housing is capable of rotation between a first position and a second position to change a value of said first angle between said first passage axis and said first axis or said line extending parallel to said first axis.

44. The detector of claim 43 further comprising power means for rotating said inlet housing.

45. The detector of claim 44 further comprising control means in signal communication with said power means said control means responsive to operator instructions or operating conditions to set said inlet housing in said first position or said second position.

46. A method of operating a detector for determining mass to charge ratios of ions comprising the steps of providing at least one high pressure vessel for creating ions and at least one low pressure vessel for creating a signal corresponding to the mass and charge of the ion, said high pressure vessel and low pressure vessel having at least one first wall and an opening allowing fluid and ionic communication between said low pressure vessel and said high pressure vessel, said high pressure vessel having at least one plume forming means and a first axis and said low pressure vessel having a second axis, said high pressure vessel having an inlet housing for mounting on said first wall between an area of low pressure and an area of high pressure, said inlet housing having a junction point, a first passage and at least one of said inlet housing and said wall having a second passage, said first passage having a first passage axis, an entrance end and a terminal end, said entrance end in fluid communication with said area of high pressure and said terminal end in communication with said junction point, said junction point in fluid communication with said second passage, said second passage having a second passage axis, and an exit, said first passage for receiving ions and said exit for discharging ions into said area of low pressure; said first passage axis intersecting said first axis or a line extending parallel to said first axis at a point and defining a first angle, said first passage axis and said second passage axis intersecting at a point and defining a second angle, and said second passage axis defining said second axis or extending along a line parallel to said second axis, said inlet housing for receiving ions at high pressure and passing ions at low pressure into said low pressure vessel wherein said inlet housing is capable of rotation between a first position and a second position to change a value of said first angle between said first passage axis and said first axis or said line extending parallel to said first axis, and said method comprises the step of rotating said inlet housing to select said first or second position.

47. The method of claim 46 further comprising power means for rotating said inlet housing.

48. The method of claim 47 further comprising control means in signal communication with said power means said control means responsive to operator instructions or operating conditions to set said inlet housing in said first position or said second position.

* * * * *